US009254687B2

(12) United States Patent
Ohnishi

(10) Patent No.: US 9,254,687 B2
(45) Date of Patent: Feb. 9, 2016

(54) PRINTING METHOD AND PRINTING DEVICE

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/385,998

(22) PCT Filed: Mar. 12, 2013

(86) PCT No.: PCT/JP2013/056863
§ 371 (c)(1),
(2) Date: Sep. 17, 2014

(87) PCT Pub. No.: WO2013/146235
PCT Pub. Date: Oct. 3, 2013

(65) Prior Publication Data

US 2015/0035919 A1 Feb. 5, 2015

(30) Foreign Application Priority Data

Mar. 27, 2012 (JP) ..... 2012-072189

(51) Int. Cl.
*B41J 2/01* (2006.01)
*B41J 11/00* (2006.01)
(Continued)

(52) U.S. Cl.
CPC ..... *B41J 11/002* (2013.01); *B41F 16/00* (2013.01); *B41F 17/001* (2013.01);
(Continued)

(58) Field of Classification Search
CPC ..... B41J 11/002; B41J 2/0057; B41F 16/00; B41F 17/001; B41F 17/006; B41F 17/30; B41M 3/12; B41M 7/0081
USPC ..... 347/102, 103
See application file for complete search history.

(56) References Cited

U.S. PATENT DOCUMENTS

2004/0090507 A1* 5/2004 Mabbot ..... 347/103
2004/0252173 A1* 12/2004 Ben-Zur et al. ..... 347/101
(Continued)

FOREIGN PATENT DOCUMENTS

CN 102199402 9/2011
JP 60-025756 2/1985
(Continued)

OTHER PUBLICATIONS

"International Search Report (Form PCT/ISA/210)", mailed on May 21, 2013, with English translation thereof, p. 1-p. 4.
(Continued)

*Primary Examiner* — Stephen Meier
*Assistant Examiner* — Alexander D Shenderov
(74) *Attorney, Agent, or Firm* — Jianq Chyun IP Office

(57) ABSTRACT

The invention is intended to produce a high-quality print image in a simple fashion. As a solution, there is provided a printing method for transferring an applied ink on a transfer medium 1 to a printing target 5. The method includes a first applying step of forming an image layer 2 on the transfer medium 1; a first curing step of curing the image layer 2; a second applying step of forming an adhesive layer 4 on the image layer 2; a second curing step of curing the adhesive layer 4 to such an extent as to maintain the adhesiveness of the adhesive layer 4; a transfer step of transferring the image layer 2 to the printing target 15; and a third curing step of further curing the adhesive layer 4.

9 Claims, 3 Drawing Sheets

(51) Int. Cl.

| | |
|---|---|
| ***B41M 3/12*** | (2006.01) |
| ***B41M 7/00*** | (2006.01) |
| ***B41J 2/005*** | (2006.01) |
| ***B41F 16/00*** | (2006.01) |
| ***B41F 17/00*** | (2006.01) |
| ***B41F 17/30*** | (2006.01) |

(52) U.S. Cl.
CPC ..... *B41F 17/006* (2013.01); *B41F 17/30* (2013.01); *B41J 2/0057* (2013.01); *B41M 3/12* (2013.01); *B41M 7/0081* (2013.01)

(56) References Cited

U.S. PATENT DOCUMENTS

| | | | | |
|---|---|---|---|---|
| 2005/0126414 | A1* | 6/2005 | Weiss et al. ..... | 101/491 |
| 2006/0066704 | A1* | 3/2006 | Nishida ..... | 347/103 |
| 2007/0120930 | A1* | 5/2007 | Domoto et al. ..... | 347/102 |

FOREIGN PATENT DOCUMENTS

| | | |
|---|---|---|
| JP | 63-186228 | 8/1988 |
| JP | 10-000887 | 1/1998 |
| JP | 2000-071418 | 3/2000 |
| JP | 2000-168043 | 6/2000 |
| JP | 2006-130725 | 5/2006 |
| JP | 2007-296830 | 11/2007 |
| JP | 2009-184206 | 8/2009 |
| JP | 2010-143073 | 7/2010 |
| JP | 2011-140133 | 7/2011 |
| WO | 2011092927 | 8/2011 |
| WO | 2011111689 | 9/2011 |

OTHER PUBLICATIONS

"Office Action of Japan Counterpart Application", issued on Jul. 21, 2015, pp. 1-10, with English translation thereof.

"Office Action of China Counterpart Application", issued on Aug. 11, 2015, pp. 1-19, with English translation thereof.

"Dictionary of Chemistry Terms for Daily Use", Edited by Sun Bao-Guao, Published by Chemistry Industry Press, pp. 920-921, Jun. 2002, Beijing.

* cited by examiner

FIG. 1
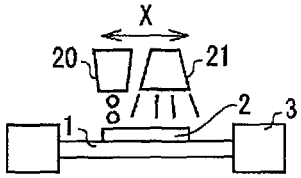
FIG. 1A
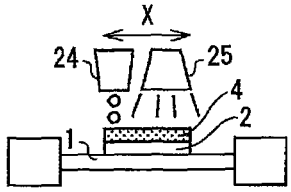
FIG. 1B
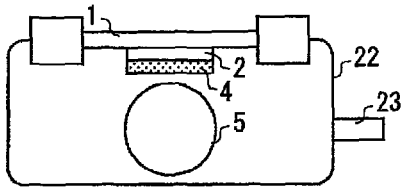
FIG. 1C
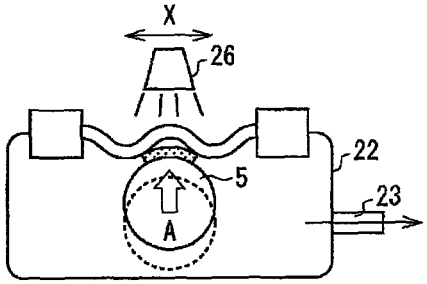
FIG. 1D
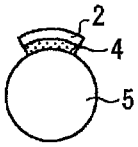
FIG. 1E FIG.2
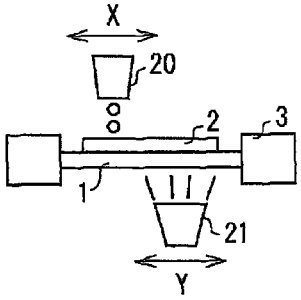
FIG.3
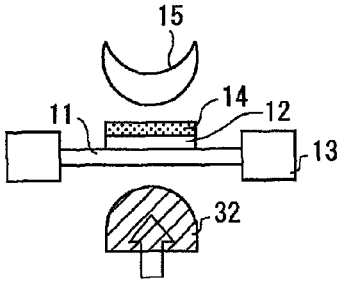
FIG. 3A
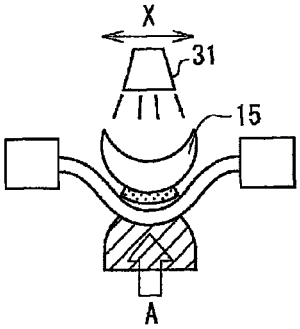
FIG. 3B
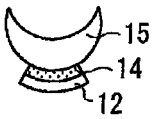
FIG. 3C
FIG.4
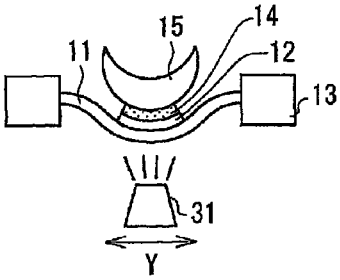

PRINTING METHOD AND PRINTING DEVICE

CROSS-REFERENCE TO RELATED APPLICATION

This application is a 371 application of the International PCT application serial no. PCT/JP2013/056863, filed on Mar. 12, 2013, which claims the priority benefits of Japan Patent Application No. 2012-072189 filed on Mar. 27, 2012. The entirety of each of the above-mentioned patent applications is hereby incorporated by reference herein and made a part of this specification.

TECHNICAL FIELD

The present invention relates to a printing method and a printing device.

BACKGROUND ART

An offset printing method based on the inkjet scheme is described in PTL 1. The method described in PTL 1 includes a first step of printing a UV ink image on a flat original sheet by using inkjet printing with a UV ink, a second step of irradiating the UV ink image with UV or an electron beam to bring the UV ink image to a semi-dry state while the UV ink image is being printed or immediately after the UV ink image is printed, a third step of transferring the semi-dry UV ink image to an elastic blanket surface, a fourth step of offset printing the transferred UV ink image from the elastic blanket to a printing object, and a step of drying and fixing the UV ink image formed by the offset printing.

CITATION LIST

Patent Literature

PTL 1: JP-A-2006-130725 (published May 25, 2006)

SUMMARY OF INVENTION

Technical Problem

The technique described in PTL 1 requires two image transfer steps, from the flat original sheet to the elastic blanket, and from the elastic blanket to a printing object. Aside from requiring more than one transfer step, the need to clean the flat original sheet and the elastic blanket after each transfer adds complexity to the process.

Another drawback of the technique described in PTL 1 is that the multiple transfer steps disturb and deteriorate the print image while the print image is being pressed for transfer.

The present invention has been made in view of the foregoing problems, and it is an object of the present invention to provide a printing method and a printing device with which a high-quality print image can be obtained in a simple fashion.

Solution to Problem

In order to solve the foregoing problems, the present invention provides a printing method for transferring an applied ink on a transfer medium to a printing target, the method including:

a first applying step of applying a UV curable resin-containing ink to the transfer medium, and forming an image layer on the transfer medium;

a first curing step of UV irradiating and curing the image layer;

a second applying step of applying a UV curable resin-containing adhesive to at least a part of the image layer after the first curing step, and forming an adhesive layer on the image layer;

a second curing step of UV irradiating and curing the adhesive layer to such an extent as to maintain the adhesiveness of the adhesive layer;

a transfer step of attaching the adhesive layer to the printing target after the second curing step, and transferring the image layer to the printing target; and a third curing step of UV irradiating and further curing the adhesive layer attached to the printing target.

The printing method according to the present invention forms the adhesive layer on the image layer formed on the transfer medium, and enables the image layer to be transferred to the printing target in a single transfer step. This makes it possible to prevent the print image from being disturbed or deteriorated while applying pressure for transfer.

Further, because the image layer is cured in the first curing step, the image quality does not deteriorate while being pressed for transfer, and a high-quality print image can be obtained.

The method thus enables producing a high-quality print image in a simple fashion.

It is preferable in the printing method according to the present invention that the third curing step be performed while the adhesive layer is being attached to the printing target in the transfer step.

The adhesive layer is UV irradiated and cured while being attached to the printing target. This makes it possible to reduce the printing time more than when the adhesive layer is cured after the transfer step.

It is preferable in the printing method according to the present invention that the transfer medium be UV transmissive, and that the third curing step LW irradiate the adhesive layer through the transfer medium and the image layer from the side of the transfer medium opposite the surface on which the image layer is formed.

The UV light on the side of the transfer medium opposite the surface on which the image layer is formed passes through the transfer medium, and irradiates the adhesive layer. This makes it possible to UV irradiate the adhesive layer while the adhesive layer is being attached to the printing target. Further, because the transfer medium and the printing target can be separated after further curing the adhesive layer in the third curing step, the image layer can be detached from the transfer medium without being disturbed, and the resulting printing target can have a high-quality transfer image.

It is preferable in the printing method according to the present invention that the printing target be UV transmissive, and that the third curing step UV irradiate the adhesive layer through the printing target from the side of the printing target opposite the surface attached to the adhesive layer.

The UV light on the side of the printing target opposite the surface attached to the adhesive layer passes through the printing target, and irradiates the adhesive layer. This makes it possible to UV irradiate the adhesive layer while the adhesive layer is being attached to the printing target. Further, because the transfer medium and the printing target can be separated after further curing the adhesive layer in the third curing step, the image layer can be detached from the transfer medium without being disturbed, and the resulting printing target can have a high-quality transfer image.

It is preferable in the printing method according to the present invention that the transfer medium be an elastic sheet, and that the transfer step sticks the transfer medium firmly to the printing target for transfer under a reduced pressure created inside a vent-equipped cabinet by drawing air out of the cabinet through the vent after the transfer medium from the second curing step is placed in the cabinet with a vent or installed to cover an opening of the cabinet when the cabinet has an opening other than the vent and after the printing target is placed in the cabinet.

Because the transfer medium is elastic, the image layer can be transferred to various different shapes of the printing target. It also becomes easier to control the transfer rate, and perform a transfer to the printing target when the printing target has large irregularities or a large area. This is because of the use of the atmospheric pressure, which makes it easier to more uniformly apply pressure.

It is preferable in the printing method according to the present invention that the transfer medium be an elastic sheet, and that the transfer step sticks the transfer medium firmly to the printing target for transfer under the pressure of a pad pressed against the transfer medium from the side of the transfer medium opposite the surface on which the image layer is formed.

Because the transfer medium is elastic, the image layer can be transferred to various different shapes of the printing target. Further, because the pad is used to press the transfer medium, the image layer can more efficiently transfer to the printing target.

It is preferable in the printing method according to the present invention that the first curing step incompletely cure the image layer.

When the image layer is completely cured in the first curing step, the adhesion between the image layer and the adhesive layer may become insufficient, and may fail to properly attach these layers. In this case, the image layer may be disturbed or detached from the adhesive layer while being transferred to the printing target, and may fail to transfer to the printing target.

On the other hand, when the image layer is incompletely cured in the first curing step, the adhesion between the image layer and the adhesive layer becomes stronger, and sufficiently attaches these layers. This makes it possible to prevent the image layer from being detached from the adhesive layer during the transfer to the printing target, and to desirably transfer the image layer to the printing target without disturbing the image layer.

It is preferable in the printing method according to the present invention that the adhesive layer contain at least one of a white ink and a silver colored ink.

By containing such an ink, the adhesive layer also can serve as the background layer of the image layer. Further, by transferring both the background layer and the image layer to the printing target, the background layer can serve to provide a clear image, irrespective of the color of the printing target.

The printing device according to the present invention is a printing device for transferring an applied ink on a transfer medium to a printing target, the device including:

first applying means that applies a UV curable resin-containing ink to the transfer medium, and forms an image layer on the transfer medium;

first UV irradiating means that UV irradiates and cures the image layer;

second applying means that applies a UV curable resin-containing adhesive to at least apart of the image layer, and forms an adhesive layer on the image layer;

second UV irradiating means that UV irradiates and cures the adhesive layer to such an extent as to maintain the adhesiveness of the adhesive layer;

transfer means that attaches and transfers the image layer to the printing target; and third UV irradiating means that UV irradiates and cures the adhesive layer attached to the printing target.

In the printing device according to the present invention, the second applying means forms the adhesive layer on the image layer formed on the transfer medium, and the image layer can transfer to the printing target in a single transfer step. This makes it possible to prevent the print image from being disturbed or deteriorated while applying pressure with the transfer means for transfer.

Further, because the first UV irradiating means cures the image layer, the image quality does not deteriorate during the transfer performed under applied pressure, and a high-quality print image can be obtained.

The device thus enables producing a high-quality print image in a simple fashion.

Advantageous Effects of Invention

The printing method and the printing device according to the present invention can advantageously produce a high-quality print image in a simple fashion.

BRIEF DESCRIPTION OF DRAWINGS

FIG. 1A to FIG. 1E are diagrams schematically representing a printing method according to an embodiment of the present invention.

FIG. 2 is a diagram schematically representing a UV irradiation method according to an embodiment of the present invention.

FIG. 3A to FIG. 3C are diagrams schematically representing a printing method according to another embodiment of the present invention.

FIG. 4 is a diagram schematically representing a UV irradiation method according to another embodiment of the present invention.

DESCRIPTION OF EMBODIMENTS

Figure 5:
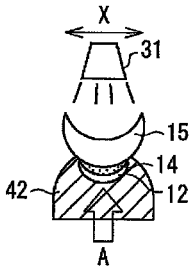
FIG. 5 is a diagram schematically representing a UV irradiation method according to a variation of another embodiment of the present invention.

Embodiments of the present invention are described below in detail.

[First Embodiment]

<Printing Method>

The printing method according to the present invention is a method for transferring an applied ink on a transfer medium to a printing target, and includes a first applying step of applying a UV curable resin-containing ink to the transfer medium, and forming an image layer on the transfer medium, and a first curing step of UV irradiating and curing the image layer. The method also includes a second applying step of applying a UV curable resin-containing adhesive to at least a part of the image layer after the first curing step, and forming an adhesive layer on the image layer, and a second curing step of UV irradiating and curing the adhesive layer to such an extent as to maintain the adhesiveness of the adhesive layer. The method also includes a transfer step of attaching the adhesive layer to the printing target after the second curing step, and transferring the image layer to the printing target, and a third curing step of UV irradiating and further curing the adhesive layer attached to the printing target. An embodiment of the printing method according to the present invention is described below in detail with reference to FIG. 1A to FIG.

1E and FIG. 2. FIG. 1A to FIG. 1E are diagrams schematically representing the printing method according to an embodiment of the present invention. FIG. 2 is a diagram schematically representing a UV irradiation method according to an embodiment of the present invention.

(Transfer Medium 1)

As shown in FIG. 1A to FIG. 1E, a transfer medium 1 according to the present embodiment is a sheet-like elastic member used to transfer the applied ink to a printing target 5.

The material of the transfer medium used in the present invention may be, for example, a silicon rubber. Other examples include various rubbers such as a fluororubber, a butyl rubber, a chloroprene rubber, a urethane rubber, a butadiene rubber, a neoprene rubber, and an ethylene propylene rubber (EPDM), and elastomer resins. These may be used either individually or in combination as composite materials, as may be selected according to the intended purpose.

When the transfer medium is disposable, the transfer medium may be made of a material that does not restore its shape, instead of using a material, such as rubber, that returns to the original shape when the applied pressure is removed. Examples of such non-restoring materials include crystalline or amorphous thermoplastic thin resin films such as a laminate film.

The hardness and the thickness of the transfer medium may be appropriately varied according to the shape of the printing target (described later). For example, the transfer medium preferably has lower hardnesses and thinner thicknesses as the shape of the printing target becomes more complex. When the printing target is a flat plate, the transfer medium may have a form of a rubber plate, instead of a sheet.

(Printing Target 5)

As shown in FIG. 1D and FIG. 1E, an image layer 2 transfers to a printing target 5 upon being attached thereto via an adhesive layer 4. The printing target 5 is spherical in shape in the present embodiment. However, the shape of the printing target used in the printing method according to the present invention is not limited to this, and the printing target may have various different shapes for printing.

(Image Layer 2)

As shown in FIG. 1A, the image layer 2 is a layer formed by applying a UV curable resin-containing ink to the transfer medium 1 through an inkjet head 20. The image layer 2 formed on the transfer medium 1 is eventually transferred to the printing target 5.

The UV curable resin-containing ink is, for example, an ink that contains a UV curable resin and a solvent.

Examples of the UV curable resin include cation polymerizable resin, radical polymerizable resin, and a mixture of these. The UV curable resin may have a viscosity as may be decided according to the intended purpose. For example, the UV curable resin may be a low-viscosity monomer or oligomer, or a high-viscosity monomer or oligomer. Specifically, the viscosity of the UV curable resin is 30 to 100,000 mPa·sec, preferably 100 to 2,000 mPa·sec.

The ink may have a viscosity as may be decided according to the intended purpose, preferably a viscosity of 3 mPa·sec to 20 mPa·sec at 25° C. in the state before curing. Applying means such as an inkjet head can easily eject the ink in this viscosity range.

The solvent may be appropriately selected according to such factors as the type of the UV curable resin, and may be, for example, at least one selected from the group consisting of glycol ether solvents (such as propylene glycol methyl ether acetate, and propylene glycol methyl ether), γ-butyrolactone, and cyclohexanone.

(Adhesive Layer 4)

As shown in FIG. 1B, the adhesive layer 4 is formed by applying an adhesive to the image layer 2. The adhesive layer 4 is a layer that attaches to the printing target 5 for transfer of the image layer 2 to the printing target 5.

The adhesive contains UV curable resin. Examples of the UV curable resin include cation polymerizable resin, radical polymerizable resin, and a mixture of these. The UV curable resin contained in the adhesive may be the same UV curable resin contained in the ink, or may be a different resin.

The adhesive may have a viscosity as may be decided according to the intended purpose, preferably a viscosity of 2 mPa·sec to 50 mPa·sec at 25° C. in the state before curing. Applying means such as an inkjet head can easily eject the adhesive in this viscosity range.

The adhesive may contain a solvent. The solvent may be, for example, the same solvent contained in the ink.

The adhesive layer may also contain a color ink or a clear ink that forms an image different from the image layer, and may contain at least one of a white ink and a silver colored ink. By containing such an ink, the adhesive layer also can serve as the background layer of the image layer. Further, by transferring both the background layer and the image layer to the printing target, the background layer can serve to provide a clear image layer, irrespective of the color of the printing target. Further, no other base needs to be formed for the image layer when the adhesive layer is used as the base of the printing target.

[First Applying Step]

First, as shown in FIG. 1A, ink is applied through the inkjet head (first applying means) 20 to the transfer medium 1 supported by a holder 3 at the both ends. This forms the image layer 2 on the transfer medium 1.

The holder 3 supports the both ends of the transfer medium 1. The holder 3 is provided to maintain the flatness of the transfer medium 1, and to improve transferability for the printing target 5.

The inkjet head 20 ejects and applies the UV curable resin-containing ink to the transfer medium 1 through its nozzles formed on the surface opposite the transfer medium 1, and forms the image layer 2 on the transfer medium 1. The inkjet head 20 ejects the ink onto the transfer medium 1 through the nozzles as it scans in the direction of arrow X.

A coating agent may be applied to the transfer medium 1 before forming the image layer 2 on the transfer medium 1 and formed a coating layer, and the image layer 2 may be formed on the coating layer. This provides a coating for the image layer 2 transferred to the printing target 5.

[First Curing Step]

As shown in FIG. 1A, the image layer 2 is irradiated with ultraviolet light from a UV irradiator (first UV irradiating means) 21 while being formed on the transfer medium 1 with the inkjet head 20. The UV irradiator 21 is provided adjacent the inkjet head 20, and irradiates ultraviolet light (hereinafter, also referred to as "UV") on the image layer 2 as it scans in the direction of arrow X. The UV irradiation cures the UV curable resin contained in the image layer 2, and the image layer 2 cures.

The UV irradiator 21 may be, for example, a UV-LED lamp, a metal halide lamp, a black light, a sterilization lamp, a xenon lamp, or a combination of these. The ultraviolet light wavelength may be, for example, 350 nm to 410 nm.

In this step, the image layer 2 is cured to such an extent that the image layer 2 does not bleed in the subsequent transfer step. However, it is preferable that the image layer does not cure completely. When the image layer 2 is completely cured, the adhesion between the image layer 2 and the adhesive layer 4 may become insufficient, and may fail to properly attach these layers. On the other hand, when the image layer 2 is incompletely cured, the adhesion between the image layer 2 and the adhesive layer 4 becomes stronger, and sufficiently attaches these layers. This makes it possible to prevent the image layer 2 from being detached from the adhesive layer 4 during the transfer to the printing target 5, and to desirably transfer the image layer 2 to the printing target 5 without disturbing the image layer 2.

Despite that the image layer 2 may be incompletely cured in this step, the image layer 2 is completely cured when curing the adhesive layer in the subsequent second curing step and third curing step.

It is preferable in the first curing step of the printing method according to the present invention that the ink viscosity thickens to 100 mPa·sec to 20,000 mPa·sec upon curing the image layer. When the ink forming the image layer thickens to this viscosity range, the image layer can be prevented from bleeding during the transfer to the printing target. Further, the image layer can desirably transfer to the printing target without being disturbed during the transfer to the printing target.

The curing of the image layer 2 in the first curing step may be performed while forming the image layer 2 on the transfer medium 1 with the ink applied to the transfer medium 1 as above. Alternatively, the first curing step may be performed after the completion of the first applying step. When the image layer 2 is cured while being formed on the transfer medium 1 in multi-pass printing, variation may occur in the extent of the curing of the image layer 2. On the other hand, the image layer 2 can be cured more uniformly when the first curing step is performed after the completion of the first applying step.

When the transfer medium 1 is UV transmissive, the image layer 2 may be UV irradiated through the transfer medium 1 from the side of the transfer medium 1 opposite the surface on which the image layer 2 is formed, using the UV irradiator 21 scanned in the direction of arrow Y, as shown in FIG. 2. In this case, the curing of the image layer 2 in the first curing step may be performed while forming the image layer 2 on the transfer medium 1 with the ink applied to the transfer medium 1. Here, it is required that the UV light from the UV irradiator 21 does not shine the inkjet head 20, so that the ink ejected from the inkjet head 20 does not cure before it reaches the transfer medium 1. To this end, it is preferable that the UV irradiator 21 irradiates the image layer 2 on the transfer medium 1 with the UV light at the position that does not expose the inkjet head 20 to the UV light emitted by the UV irradiator 21, as shown in FIG. 2.

[Second Applying Step]

In the next step, an inkjet head (second applying means) 24 is used to apply the adhesive to the image layer 2 and form the adhesive layer 4 on the image layer 2, as shown in FIG. 1B.

The inkjet head 24 ejects and applies the UV curable resin-containing adhesive to the image layer 2 through its nozzles formed on the surface opposite the transfer medium 1, and forms the adhesive layer 4 on the image layer 2. The inkjet head 24 ejects the adhesive onto the image layer 2 through the nozzles as it scans in the direction of arrow X.

The adhesive is applied to the image layer 2 through applying means such as an inkjet head. It is not necessarily required to apply the adhesive throughout the image layer 2, and the adhesive may be applied to only a part of the image layer 2, provided that the image layer 2 can be transferred to the printing target 5.

[Second Curing Step]

A UV irradiator (second UV irradiating means) 25 cures the adhesive layer 4 by irradiation of UV light to such an extent as to maintain the adhesiveness of the adhesive layer 4 while the adhesive layer 4 is being formed on the image layer 2 with the inkjet head 24, as shown in FIG. 1B. The UV irradiator 25 is provided adjacent the inkjet head 24, and UV irradiates the adhesive layer 4 as it scans in the direction of arrow X. The UV irradiation cures the UV curable resin contained in the adhesive layer 4, and the adhesive layer 4 cures.

It is preferable in the second curing step of the printing method according to the present invention that the adhesive viscosity thickens to 100 mPa·sec to 20,000 mPa·sec upon curing the adhesive layer to such an extent as to maintain adhesiveness. As used herein, "maintaining adhesiveness" means that the adhesive layer remains adherent after the second curing step. Specifically, the adhesive layer needs to maintain adhesiveness that is enough to attach the image layer to the printing target, and the extent of remaining adhesiveness (adhesion strength) is not particularly limited.

The curing of the adhesive layer 4 in the second curing step may be performed while forming the adhesive layer 4 on the image layer 2 with the adhesive applied to the image layer 2. Alternatively, the second curing step may be performed after the completion of the second applying step.

When the transfer medium 1 is UV transmissive, the adhesive layer 4 may be UV irradiated through the transfer medium 1 and the image layer 2 from the side of the transfer medium 1 opposite the surface on which the adhesive layer 4 is formed. In this case, the curing of the adhesive layer 4 in the second curing step may be performed while forming the adhesive layer 4 on the image layer 2 with the adhesive applied to the image layer 2.

[Transfer Step]

The printing target 5 is installed in a vacuum chamber (cabinet, transfer means) 22, as shown in FIG. 1C. The transfer medium 1 is installed in such a manner that the image layer 2 and the adhesive layer 4 are positioned inside the vacuum chamber 22, and that the opening of the vacuum chamber 22 is covered with the transfer medium 1 upon joining the vacuum chamber 22 to the holder 3 attached to the both ends of the transfer medium 1.

The vacuum chamber 22 has a vent 23 for admitting and releasing air. The pressure inside the vacuum chamber 22 can be adjusted by taking air in and out of the vacuum chamber 22 through the vent 23.

Because the transfer medium 1 is an elastic sheet, the transfer medium 1 bends upon creating a reduced pressure inside the vacuum chamber 22 by drawing air out of the vacuum chamber 22 through the vent 23, as shown in FIG. 1D. The printing target 5 moves in the direction of arrow A, and the transfer medium 1 sticks firmly to the printing target 5 via the adhesive layer 4. The image layer 2 can then transfer to the printing target 5.

Because the transfer medium 1 is an elastic sheet-like member, the transfer medium 1 deforms to conform to the shape of the printing target 5. The image layer can thus transfer to various shapes of the printing target with the use of the cabinet. Further, the use of the atmospheric pressure makes it easier to more uniformly apply pressure, and to more easily control the transfer rate. This makes it easier to perform a transfer to a printing target that has large irregularities or a large area.

Instead of covering the cabinet opening by installing the transfer medium in the opening, the image layer may be transferred to the printing target with the transfer medium being placed in the cabinet having a vent.

[Third Curing Step]

The adhesive layer 4 is further cured by irradiation of UV light from a UV irradiator (third UV irradiating means) 26 while the adhesive layer 4 being attached to the printing target 5, as shown in FIG. 1D. When the transfer medium 1 is UV transmissive, the UV irradiator 26 may UV irradiate the adhesive layer 4 via the transfer medium 1 and the image layer 2 from the side of the transfer medium 1 opposite the surface on which the image layer 2 is formed.

Here, the adhesive layer 4 can be UV irradiated without separating the transfer medium 1 and the printing target 5 from each other. The image layer 2 can thus be detached from the transfer medium 1 after the further curing of the adhesive layer 4. Because this prevents the image layer 2 from being disturbed, the resulting printing target 5 can have a high-quality transfer image.

The third curing step of the printing method according to the present invention further cures the adhesive layer, and is finished upon completely curing the adhesive layer.

The third curing step of curing the adhesive layer may be performed after the transfer step. However, the printing time can be further reduced when the adhesive layer 4 is UV irradiated while being attached to the printing target 5 as in the present embodiment.

The image layer 2 is detached from the transfer medium 1 after the transfer step. The result is the printing target 5 with the transferred image layer 2, as shown in FIG. 1E.

The foregoing steps may be performed with an appropriate use of a heater to evaporate the solvent contained in the ink. The transfer step may be performed at room temperature, or participating members such as the adhesive layer may be heated to certain temperature with a heater to stabilize transfer conditions.

In the printing method according to the present invention, when the transfer medium is not UV transmissive, the further curing of the adhesive layer in the third curing step may be performed after the image layer is detached from the transfer medium, after the transfer step.

The UV irradiator 21, the UV irradiator 25, and the UV irradiator 26 used in the first curing step, the second curing step, and the third curing step, respectively, in the present embodiment may be replaced with a common UV irradiator.

In contrast to the conventional technique requiring a total of two transfers, the printing method according to the present invention forms the adhesive layer on the image layer formed on the transfer medium, and enables the image layer to be transferred to the printing target in a single transfer step. This makes it possible to prevent the print image from being disturbed or deteriorated while applying pressure for transfer.

Further, because the image layer is cured in the first curing step, the image quality does not deteriorate during the transfer performed under applied pressure, and a high-quality print image can be obtained.

The method thus enables producing a high-quality print image in a simple fashion.

<Printing Device>

The printing device according to the present invention is a device that creates an image layer on a transfer medium with the ink applied to the transfer medium, and transfers the image layer to a printing target. The printing device according to the present invention includes first applying means, first UV irradiating means, second applying means, second UV irradiating means, transfer means, and third UV irradiating means.

An embodiment of the configuration of each means in the printing device according to the present invention is described below. The embodiment of the configuration of each means of the printing device is applicable to perform the steps of the printing method of the present invention described above. Accordingly, the embodiment of the printing device according to the present invention follows the descriptions of the printing method above, and detailed explanations thereof will be omitted.

[First Applying Means]

The first applying means is not limited, as long as it can apply ink to the transfer medium, and form the desired image layer on the transfer medium. An example of the first applying means is an inkjet head. The inkjet head 20 corresponds to the first applying means.

[First UV Irradiating Means]

The first UV irradiating means cures the image layer by UV irradiation of the image layer formed by the first applying means. Examples of the first UV irradiating means include a UV-LED lamp, a metal halide lamp, a black light, a sterilization lamp, a xenon lamp, or a combination of these. The ultraviolet light wavelength may be, for example, 350 nm to 410 nm. The UV irradiator 21 corresponds to the first UV irradiating means.

[Second Applying Means]

The second applying means is not limited, as long as it can apply a UV curable resin-containing adhesive to the image layer cured by the first UV irradiating means, and form an adhesive layer on the image layer. An example of the second applying means is an inkjet head. The inkjet head 24 corresponds to the second applying means.

[Second UV Irradiating Means]

The second UV irradiating means UV irradiates the adhesive layer formed by the second applying means, and cures the adhesive layer to such an extent as to maintain the adhesiveness of the adhesive layer. The second UV irradiating means may have the same configuration as the first UV irradiating means. The UV irradiator 25 corresponds to the second UV irradiating means. Preferably, the second UV irradiating means is one that can modulate and produce UV light of weak irradiation intensity so that the adhesive layer can be cured to such an extent as to maintain the adhesiveness of the adhesive layer.

[Transfer Means]

The transfer means transfers the image layer to the printing target by attaching the adhesive layer formed on the transfer medium to the printing target. An example of the transfer means is a vent-equipped cabinet adapted to accommodate the transfer medium and the printing target. In addition to the vent, the cabinet may have an opening that can be covered with the transfer medium installed therein. For example, the vacuum chamber 22 corresponds to the transfer means. Other examples of the transfer means include a pad that is pressed against the transfer medium to stick the transfer medium firmly to the printing target, as will be described in Second Embodiment below. For example, a pad 32 (described later) corresponds to the transfer means.

[Third UV Irradiating Means]

The third UV irradiating means cures the adhesive layer by UV irradiation of the adhesive layer attached to the printing target. The third UV irradiating means may have the same configuration as the first UV irradiating means. The UV irradiator 26 corresponds to the third UV irradiating means.

The first UV irradiating means, the second UV irradiating means, and the third UV irradiating means may be the same or different. The first UV irradiating means may be provided in the first applying means. The second UV irradiating means may be provided in the second applying means.

The printing device according to the present invention may also include heating means, such as a heater, for the purpose of evaporating the solvent contained in the ink. Examples of the heating means include a ceramic heater, a tungsten heater, a sheathed wire heater, a far infrared heater, an IH heater, a hot-air heater, and combinations of these.

The printing device according to the present invention enables the image layer to be transferred to the printing target in a single transfer, and can produce a high-quality print image without deteriorating image quality.

(Second Embodiment)

<Printing Method>

The printing method of Second Embodiment for transferring an applied ink on a transfer medium to a printing target is described below with reference to FIG. 3A to FIG. 3C and FIG. 4. FIG. 3A to FIG. 3C are diagrams schematically representing the printing method according to another embodiment of the present invention. FIG. 4 is a diagram schematically representing a UV irradiation method according to another embodiment of the present invention.

The printing method according to Second Embodiment differs from the printing method of First Embodiment in that an image layer 12 is transferred to a printing target 15 in the transfer step with the use of a pad 32, instead of the vacuum chamber 22. The printing method according to the present embodiment is no different from the printing method of First Embodiment in relation to the steps from the first applying step to the second curing step, and explanations thereof will be omitted. Other common features already described in the printing method of First Embodiment will not be described either. The transfer medium 11, the image layer 12, the holder 13, the adhesive layer 14, the printing target 15, and the UV irradiator 31 of the present embodiment correspond to the transfer medium 1, the image layer 2, the holder 3, the adhesive layer 4, the printing target 5, and the UV irradiator 26, respectively, of First Embodiment, and will not be described.

[Transfer Step]

The transfer medium 11 is installed between the printing target 15 and the pad (transfer means) 32, as shown in FIG. 3A.

Thereafter, as shown in FIG. 3B, the pad 32 is pressed against the transfer medium 11 from the side of the transfer medium 11 opposite the surface on which the image layer 12 is formed, and the transfer medium 11 sticks firmly to the printing target 15, and transfers the image layer 12 to the printing target 15.

Because the transfer medium 11 is an elastic sheet-like member, the image layer 12 can be transferred to various different shapes of the printing target 15. Further, because the pad 32 is used to press the transfer medium 11, the image layer 12 can more efficiently transfer to the printing target 15.

The pad is preferably made of an elastic material, more preferably a material that can evenly apply pressure to the transfer medium. Examples of such materials include a soft rubber, a hard rubber, a sponge, and a bag filled with liquid, powder, or gas. In this way, the image layer can be transferred to various different shapes of the printing target.

[Third Curing Step]

The adhesive layer 14 is further cured by UV irradiation of the adhesive layer 14 being attached to the printing target 15, as shown in FIG. 3B. When the printing target 15 is UV transmissive, the UV irradiator 31 may UV irradiate the adhesive layer 14 through the printing target 15 from the side of the printing target 15 opposite the surface attached to the adhesive layer 14.

Here, the adhesive layer 14 can be UV irradiated without separating the transfer medium 11 and the printing target 15 from each other. The image layer 12 can thus be detached from the transfer medium 11 after the further curing of the adhesive layer 14. Because this prevents the image layer 12 from being disturbed, the resulting printing target 15 can have a high-quality transfer image.

The UV-transmissive printing target 15 may be, for example, a transparent resin member.

When the printing target 15 is not UV transmissive, and the transfer medium 11 is UV transmissive, the UV irradiator 31 may UV irradiate the adhesive layer 14 through the transfer medium 11 from the side of the transfer medium 11 opposite the surface on which the adhesive layer 14 is formed, after releasing the pressure of the pad 32, as shown in FIG. 4.

(Variation)

A variation of Second Embodiment is described below with reference to FIG. 5. FIG. 5 is a diagram schematically representing a UV irradiation method according to a variation of another embodiment of the present invention. This variation differs from Second Embodiment in that a pad (transfer medium, transfer means) 42 is used in place of the transfer medium 11 and the pad 32, and that the pad 42 also serves as the transfer medium 11. Specifically, this variation represents an exemplary form of the present invention in which the transfer medium and the transfer means are configured as a single member.

First, an ink is directly applied to the pad 42 to form the image layer 12. Thereafter, the adhesive is applied to the image layer 12 to form the adhesive layer 14. The steps from the first applying step to the second curing step are the same as in Second Embodiment except that the pad 42 replaces the transfer medium 11, and will not be described in detail.

Thereafter, as shown in FIG. 5, the adhesive layer 14 is further cured by UV irradiation while the adhesive layer 14 on the image layer 12 is being attached to the printing target 15. When the printing target 15 is UV transmissive, the UV irradiating means 31 may UV irradiate the adhesive layer 14 through the printing target 15 from the side of the printing target 15 opposite the surface attached to the adhesive layer 14.

Here, the pad 42 is pressed against the printing target 15 in the direction of arrow A from the side of the pad 42 opposite the surface on which the image layer 12 is formed. The pad 42 sticks firmly to the printing target 15, and the image layer 12 transfers to the printing target 15. The pad 42 of this variation may be the same pad used as the pad 32 described above.

Using the pad or other such transfer means as the transfer medium in the printing method of the present invention eliminates the need to separately provide the transfer medium and the transfer means, and the number of members actually used to perform the method can be reduced.

In the printing method according to the present invention, when the transfer medium and the printing target are not UV transmissive, the adhesive layer may be further cured in the third curing step after the image layer is detached from the transfer medium, after the transfer step.

The method enables producing a high-quality print image in a simple fashion as does the printing method according to First Embodiment.

[Additional Remarks]

An embodiment of the printing method according to the present invention is a printing method for transferring an applied ink on the transfer medium 1 to the printing target 5, and includes a first applying step of applying a UV curable resin-containing ink to the transfer medium 1, and forming the image layer 2 on the transfer medium 1, and a first curing step of UV irradiating and curing the image layer 2. The method also includes a second applying step of applying a UV curable resin-containing adhesive to at least apart of the image layer 2, and forming the adhesive layer 4 on the image layer 2 after the first curing step, and a second curing step of UV irradiating and curing the adhesive layer 4 to such an extent as to maintain the adhesiveness of the adhesive layer 4. The method also includes a transfer step of attaching the adhesive layer 4 to the printing target 5, and transferring the image layer 2 to the printing target 5 after the second curing step, and a third curing step of UV irradiating and further curing the adhesive layer 4 attached to the printing target 5.

Because the adhesive layer 4 is formed on the image layer 2 formed on the transfer medium 1, the image layer 2 can be transferred to the printing target 5 in a single transfer step. This makes it possible to prevent the print image from being disturbed or deteriorated while applying pressure for transfer.

Further, because the image layer 2 is cured in the first curing step, the image quality does not deteriorate during the transfer performed under applied pressure, and a high-quality print image can be obtained.

The method thus enables producing a high-quality print image in a simple fashion.

The third curing step is performed while the adhesive layer 4 is being attached to the printing target 5 in the transfer step.

The adhesive layer 4 is UV irradiated and cured while being attached to the printing target 5. This makes it possible to reduce the printing time more than when the adhesive layer 4 is cured after the transfer step.

The transfer medium 1 is UV transmissive, and the adhesive layer 4 is UV irradiated in the third curing step through the transfer medium 1 and the image layer 2 from the side of the transfer medium 11 opposite the surface on which the image layer 2 is formed.

The UV light on the side of the transfer medium 1 opposite the surface on which the image layer 2 is formed passes through the transfer medium 1, and irradiates the adhesive layer 4. This makes it possible to UV irradiate the adhesive layer 4 while the adhesive layer 4 is being attached to the printing target 5. Further, because the transfer medium 1 and the printing target 5 can be separated after further curing the adhesive layer 4 in the third curing step, the image layer 2 can be detached from the transfer medium 1 without being disturbed, and the resulting printing target 5 can have a high-quality transfer image.

The printing target 15 is UV transmissive, and the third curing step UV irradiates the adhesive layer 14 through the printing target 15 from the side of the printing target 15 opposite the surface attached to the adhesive layer 14.

The UV light on the side of the printing target 15 opposite the surface attached to the adhesive layer 14 passes through the printing target 15, and irradiates the adhesive layer 14. This makes it possible to UV irradiate the adhesive layer 14 while the adhesive layer 14 is being attached to the printing target 15. Further, because the transfer medium 11 and the printing target 15 can be separated after further curing the adhesive layer 14 in the third curing step, the image layer 12 can be detached from the transfer medium 11 without being disturbed, and the resulting printing target 15 can have a high-quality transfer image.

The transfer medium 1 is an elastic sheet, and the transfer step proceeds by placing the transfer medium 1 from the second curing step in the vacuum chamber 22 equipped with the vent 23, or by installing the transfer medium 1 in the opening and covering the opening of the vacuum chamber 22 when the vacuum chamber 22 has an opening in addition to the vent 23. After placing the printing target 5 in the vacuum chamber 22, the air inside the vacuum chamber 22 is drawn out through the vent 23 to create a reduced pressure therein, causing the transfer medium 1 to stick firmly to the printing target 5 for transfer.

Because the transfer medium 1 is elastic, the image layer 2 can be transferred to various different shapes of the printing target 5. It also becomes easier to control the transfer rate, and perform a transfer to the printing target 5 when the printing target 5 has large irregularities or a large area. This is because of the use of the atmospheric pressure, which makes it easier to more uniformly apply pressure.

The transfer medium 11 is an elastic sheet, and the transfer step sticks the transfer medium 11 firmly to the printing target 15 for transfer under the pressure of the pad 32 pressed against the transfer medium 11 from the side of the transfer medium 11 opposite the surface on which the image layer 12 is formed.

Because the transfer medium 11 is elastic, the image layer 12 can be transferred to various different shapes of the printing target 15. Further, because the pad 32 is used to press the transfer medium 11, the image layer 12 can more efficiently transfer to the printing target 15.

The first curing step incompletely cures the image layer 2.

When the image layer 2 is completely cured in the first curing step, the adhesion between the image layer 2 and the adhesive layer 4 may become insufficient, and may fail to properly attach these layers. In this case, the image layer 2 may be disturbed or detached from the adhesive layer 4 while being transferred to the printing target 5, and may fail to transfer to the printing target 5.

On the other hand, when the image layer 2 is incompletely cured in the first curing step, the adhesion between the image layer 2 and the adhesive layer 4 becomes stronger, and sufficiently attaches these layers. This makes it possible to prevent the image layer 2 from being detached from the adhesive layer 4 during the transfer to the printing target 5, and to desirably transfer the image layer 2 to the printing target 5 without disturbing the image layer 2.

The adhesive layer 4 contains at least one of a white ink and a silver colored ink.

By containing such an ink, the adhesive layer 4 also can serve as the background layer of the image layer 2. Further, by transferring both the background layer and the image layer 2 to the printing target, the background layer can serve to provide a clear image, irrespective of the color of the printing target.

An embodiment of the printing device according to the present invention is a printing device that transfers an applied ink on the transfer medium 1 to the printing target 5, and includes the inkjet head 20 that applies a UV curable resin-containing ink to the transfer medium 1, and forms the image layer 2 on the transfer medium 1; the UV irradiator 21 that UV irradiates and cures the image layer 2; the inkjet head 24 that applies a UV curable resin-containing adhesive to at least a part of the image layer 2, and forms the adhesive layer 4 on the image layer 2; the UV irradiator 25 that UV irradiates and cures the adhesive layer 4 to such an extent as to maintain the adhesiveness of the adhesive layer 4; the vacuum chamber 22 that attaches and transfers the image layer 2 to the printing target 5; and the UV irradiator 26 that UV irradiates and cures the adhesive layer 4 attached to the printing target 5.

In the printing device of the embodiment, the inkjet head 24 forms the adhesive layer 4 on the image layer 2 formed on the transfer medium 1, and the image layer 2 can transfer to the printing target 5 in a single transfer step. This makes it possible to prevent the print image from being disturbed or deteriorated when the vacuum chamber 22 applies pressure for transfer.

Further, because the UV irradiator 21 cures the image layer 2, the image quality does not deteriorate during the transfer performed under applied pressure, and a high-quality print image can be obtained.

The device thus enables producing a high-quality print image in a simple fashion.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The present invention is applicable to the field of printing, including multi-pass printing.

The invention claimed is:

1. A printing method for transferring an applied ink on a transfer medium to a printing target, the method comprising:

a first applying step of applying a UV curable resin-containing ink to the transfer medium, and forming an image layer on the transfer medium, wherein a viscosity of the UV curable resin-containing ink is 3 mPa·sec to 20 mPa·sec at 25° C.;

a first curing step of UV irradiating and semi-curing the image layer;

a second applying step of applying a UV curable resin-containing adhesive to at least a part of the image layer after the first curing step, and forming an adhesive layer on the image layer, wherein a viscosity of the UV curable resin-containing adhesive is 2 mPa·sec to 50 mPa·sec at 25° C.;

a second curing step of UV irradiating and semi-curing the adhesive layer to such an extent as to maintain the adhesiveness of the adhesive layer, wherein the viscosity of the semi-cured adhesive layer thickens to 100 mPa·sec to 20,000 mPa·sec;

a transfer step of attaching the adhesive layer to the printing target after the second curing step, and transferring the image layer to the printing target; and a third curing step of UV irradiating and further curing the adhesive layer and the image layer attached to the printing target.

2. The printing method according to claim 1, wherein the third curing step is performed while the adhesive layer is being attached to the printing target in the transfer step.

3. The printing method according to claim 1, wherein the transfer edium is UV transmissive, and wherein the third curing step UV irradiates the adhesive layer through the transfer medium and the image layer from the side of the transfer medium opposite the surface on which the image layer is formed.

4. The printing method according to claim 1, wherein the printing target is UV transmissive, and wherein the third curing step UV irradiates the adhesive layer through the printing target from the side of the printing target opposite the surface attached to the adhesive layer.

5. The printing method according to claim 1, wherein the transfer medium is an elastic sheet, and wherein the transfer step sticks the transfer medium firmly to the printing target for transfer under a reduced pressure created inside a vent-equipped cabinet by drawing air out of the cabinet through the vent after the transfer medium from the second curing step is placed in the cabinet or installed the transfer medium in the opening to cover an opening of the cabinet when the cabinet has an opening other than the vent and after the printing target is placed in the cabinet.

6. The printing method according to claim 1, wherein the transfer medium is an elastic sheet, and wherein the transfer step sticks the transfer medium firmly to the printing target for transfer under the pressure of a pad pressed against the transfer medium from the side of the transfer medium opposite the surface on which the image layer is formed.

7. The printing method according to claim 1, wherein the first curing step incompletely cures the image layer.

8. The printing method according to claim 1, wherein the adhesive layer contains at least one of a white ink and a silver colored ink.

9. A printing device for transferring an applied ink on a transfer medium to a printing target, the device comprising:

first applying means that applies a UV curable resin-containing ink to the transfer medium, and forms an image layer on the transfer medium, wherein a viscosity of the UV curable resin-containing ink is 3 mPa·sec to 20 mPa·sec at 25° C.;

first UV irradiating means that UV irradiates and semi-cures the image layer;

second applying means that applies a UV curable resin-containing adhesive to at least a part of the image layer, and forms an adhesive layer on the image layer, wherein a viscosity of the UV curable resin-containing adhesive is 2 mPa·sec to 50 mPa·sec at 25° C.;

second UV irradiating means that UV irradiates and semi-cures the adhesive layer to such an extent as to maintain the adhesiveness of the adhesive layer, wherein the viscosity of the semi-cured adhesive layer thickens to 100 mPa·sec to 20,000 mPa·sec;

transfer means that attaches and transfers the image layer to the printing target; and third UV irradiating means that UV irradiates and cures the adhesive layer and the image layer attached to the printing target.

* * * * *